United States Patent [19]

Sugiyama

[11] 4,394,008

[45] Jul. 19, 1983

[54] AUTOMATIC AND MANUAL SHEET FEEDING MECHANISM

[75] Inventor: Mitsuhiko Sugiyama, Ebina, Japan

[73] Assignee: Rank Xerox Limited, London, England

[21] Appl. No.: 255,935

[22] Filed: Apr. 20, 1981

[30] Foreign Application Priority Data

Apr. 25, 1980 [JP] Japan ..... 55-54115

[51] Int. Cl.[3] ..... B65H 3/06; B65H 1/26

[52] U.S. Cl. ..... 271/9; 271/118; 271/265

[58] Field of Search ..... 271/9, 10, 118, 126, 271/127, DIG. 9, 265

[56] References Cited

U.S. PATENT DOCUMENTS

| | | | |
|---|---|---|---|
| 3,586,317 | 6/1971 | Smitzer | 271/127 |
| 3,689,064 | 9/1972 | Kuksa | 271/127 |
| 3,944,212 | 3/1976 | Stange et al. | 271/DIG. 9 |
| 3,961,786 | 6/1976 | Yanker | 271/10 |
| 4,062,533 | 12/1977 | Greenberg et al. | 271/10 |
| 4,078,789 | 3/1978 | Kittredge et al. | 271/DIG. 9 |
| 4,132,401 | 1/1979 | Gauronski et al. | 271/265 |

FOREIGN PATENT DOCUMENTS

| | | |
|---|---|---|
| 53-16108 | 6/1978 | Japan . |
| 54-68142 | 8/1979 | Japan . |

*Primary Examiner*—Robert B. Reeves
*Assistant Examiner*—Donald Hajec
*Attorney, Agent, or Firm*—Robert A. Chittum

[57] ABSTRACT

A sheet feed mechanism is disclosed which will permit manual feed as well as automatic seriatim feeding. The mechanism includes a main feed roller movable into and out of contact with the top sheet of a stack, another feed roll above and in contact with the main roller and a pinch roller above and in contact with the other roller to form a nip through which a sheet may be manually guided for feeding.

3 Claims, 5 Drawing Figures

AUTOMATIC AND MANUAL SHEET FEEDING MECHANISM

This invention relates to a paper feeder for use in reproducing machines, printing machines or the like and, more specifically, it relates to a paper feeder having both automatic feeding function for feeding paper automatically and manual feeding function for feeding paper manually by an operator.

Paper feeders of the known type, as shown in FIG. 1 for use in a reproduction machine having a photoreceptor surface on a drum 1, registration rollers 2, 3 for directing copy sheets into a transfer station in contact with the drum and at which a toner image is tranferred, include, for example, a manual paper feed roller 4 with pinch roller 4*a* provided independently relative to an automatic paper feed mechanism 5. This arrangement includes an automatic paper feed roller 6 contacting a paper stack 7 under pressure. Sheets are brought into contact with the drum 1 at a transfer station A whereat a developed toner image is transferred by means of a transfer corona device 8. After transfer of the images, sheets are aided in being stripped off the drum by a suitable detack corona device 9. However, in the structure of FIG. 1, driving power is transmitted to the automatic paper feed roller 6 and the manual paper feed roller 4 through separate driving sources respectively, which complicates the structure and increases the cost.

In FIG. 2, there is shown an automatic paper feed roller 10 of an automatic paper feed mechanism adapted to be driven rotatably in forward and reverse directions and both of automatic and manual paper feedings are enabled by such an automatic paper feed roller 10. Such an arrangement is disclosed in Japanese Patent Publication No. 16108/1979 wherein manual paper feeding is enabled by an automatic paper feed roller using the upper cover or snubber of a paper containing cassette as a guide. The arrangement of FIG. 2 is also complicated and increases the cost since the rotating direction of the automatic paper feed roller 2 has to be switched in forward and reverse directions.

The present invention has been devised to obviate the disadvantages of the foregoing arrangements and has for its main object to provide a paper feeder simple in structure, inexpensive and capable of manual feeding without causing double pick-up with the set paper stack. This and other objects will become apparent from the following specification taken in conjunction with the accompanying drawings wherein.

Figure 1:
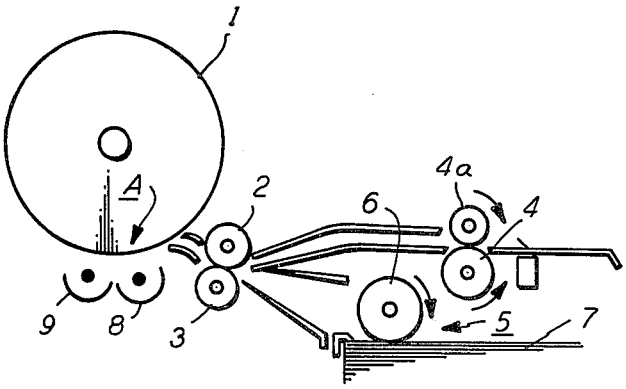
FIG. 1 PRIOR ART
FIG. 1 is a schematic view of one example of conventional paper sheet feeders.
Figure 2:
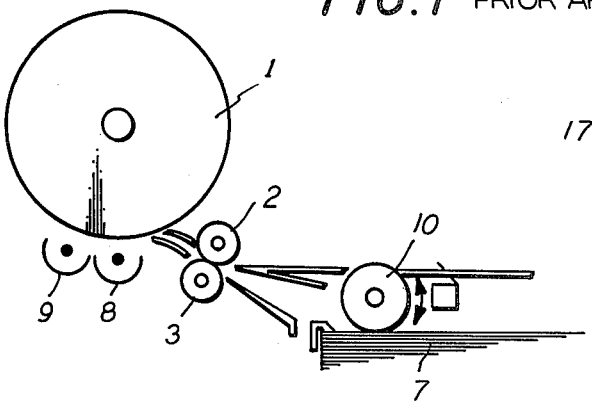
FIG. 2 PRIOR ART
FIG. 2 is a schematic view of still another example of a conventional sheet feeder.
Figure 3:
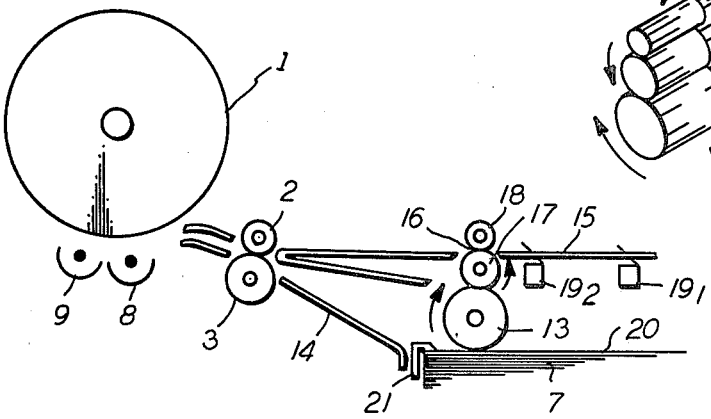
FIG. 3 is a schematic area of one embodiment of the present invention.
Figure 4:
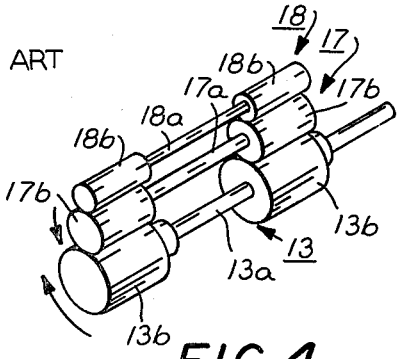
FIG. 4 is a perspective view of a drive arrangement utilized in the present invention.

As shown in FIG. 3, the paper stack is set near the photoreceptor drum 1 arranged to receive sheets by means of an automatic paper feed roller 13 to an automatic paper transporting guide plate 14 adjusted with timing by the registration rollers 2, 3 and then transported into a position opposing the transfer corona device 8 against the photoreceptor surface of the drum 1.

A manual paper transporting guide plate 15 is arranged above the roller 13 and has an opening at the midway thereof for location of the contacting nip 16 between a manual paper feed roller 17 in contact with the automatic paper feed roller 13 and a pinch roller 18. First and second manual feeding detection switches $\mathbf{19}_1$, $\mathbf{19}_2$ are disposed at the positions upstream of the nip portion 16 with an interval to each other in the transporting direction.

The automatic paper feed roller 13 has a structure comprising a pair of rubber rollers 13*b*, 13*b* on both ends of a support shaft 13*a*. The manual paper feed roller 17 has a structure comprising a pair of rubber rollers 17*b*, 17*b* on both ends of a support shaft 17*a* and the pinch roller 18 has a structure comprising a pair of rubber rollers 18*b*, 18*b* on both ends of a support shaft 18*a*. Rollers 13 and 17 remain in contact with each other at all times and roller 18 remains in contact with roller 17 at all times.

Upon automatic paper feeding, the automatic paper feed roller 13 is rotated, and the uppermost sheet of paper 20 on the paper stack 7 is separated and fed by a separation snubber 21, synchronized with a developed image on the surface of the photoconductive drum 1 by the registration rollers 2, 3 and then conveyed into contact with the drum 1. The image is tranferred by the transfer corona 8 and the sheet separated from the drum 1 by the detack corona device 9.

Upon manual paper feeding, a sheet is inserted by the operator along the manual paper guide plate transporting path 15. The first manual feeding detection switch $\mathbf{19}_1$ is thereby turned ON to detect the insertion of manually fed paper, and the detection signal causes the tray on which the paper stack 7 is loaded to lower by a driving mechanism (not shown) thereby releasing the pressure-contact between the automatic paper feed roller 13 and the paper stack 7. Alternately, the paper feed roller 13 may be adapted for movement vertically away from and contact with the stack 7.

As the sheet of paper is inserted further, the second manual feeding detection switch $\mathbf{19}_2$ is turned ON to detect the insertion of the paper, and the detection signal drives the automatic paper feed roller 13. Since the manual paper feed roller 13 is thus rotated, the paper inserted into the nip 16 between the manual roller 17 and the pinch roller 18 is sent to the registration rollers 2, 3. After this feeding, the procedures as in the automatic paper feeding mode are conducted thereafter, that is, the feed roller 13 will once again contact the stack 7 for permitting automatic seriatim sheet feed.

From the foregoing, it will be apparent that the automatic paper feeding and the manual paper feeding can be conducted by the rotation of the automatic paper feed roller 13 in only one direction, and that there is no need of another driving source for driving the manual paper feed roller 17, or for the provision of a mechanism for switching the rotating direction of the automatic paper feed roller in forward and reverse directions.

In addition, since the manual paper feeding can be conducted by manually inserting the paper to the manual paper feed roller 17, the manual paper feeding can be conducted without contacting the inserted paper to the paper stack 7 thus causing a possible double pick-up therewith. The pinch roller 18 may be contacted under pressure by its own weight to the manual paper feed roller 17 or it may be contacted under pressure using a spring or the like.

Figure 5:
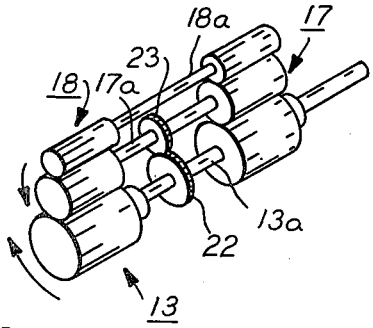
FIG. 5 is a perspective view of another embodiment of the drive arrangement.

As a further embodiment as shown in FIG. 5, the automatic paper feed roller 13 and the manual paper feed roller 17 may be connected mechanically by the provision of gears 22, 23 to support shafts 13*a*, 17*a*, respectively.

From the foregoing it will be apparent that the present invention is capable of conducting both automatic paper feeding and manual paper feeding, is simple in structure and inexpensive, and enables manual paper feeding without causing double pick-up with respect to a supply of sheets.

While the invention has been described with reference to the structure disclosed, it is not confined to the details set forth but is intended to cover such modifications or changes as may come within the scope of the following claims.

I claim:

1. A sheet feed mechanism for a reproduction machine having a photoreceptor surface to which sheets of copy paper are applied for receiving a toner image, and a supply of copy sheets comprising:

a sheet feed mechanism arranged to feed copy sheets to the photoreceptor surface seriatim from a stack of paper and having a stack contacting roller arranged to contact the top sheet of the stack;

a second sheet feed roller arranged above said stack contacting roller and in contact therewith;

a third roller arranged above said second roller and in contact therewith to form a nip therebetween;

a sheet guide means for guiding sheets manually inserted thereon and moved toward said nip;

detection means for sensing the presence of a sheet manually inserted on the sheet guide means as it is moved towards said nip;

means for driving the stack contacting roller; and means for moving the stack contacting roller out of contact with said stack while maintaining contact with said second sheet feed roller in response to said detection means sensing the presence of a sheet manually inserted on the sheet guide means, whereby said stack contacting roller rotates in a direction to feed sheets to the photoreceptor surface when in contact with the stack and rotates in the same direction to feed sheets manually through said nip when said stack contacting roller is not in contact with the stack.

2. The sheet feed mechanism of claim 1 wherein said drive means is operatively connected to said stack contacting roller and drive is applied to said second and third rollers by frictional engagement with said stack contacting roller.

3. The sheet feed mechanism of claim 1 wherein said drive means is operatively connected to said stack contacting feed roller and to said second roller.

* * * * *